United States Patent [19]

Pierce, Jr.

[11] Patent Number: 4,650,002

[45] Date of Patent: Mar. 17, 1987

[54] MAGNETIC FIRE BLANKET

[76] Inventor: Webster Pierce, Jr., 223 W. 58th St., Cut Off, La. 70345

[21] Appl. No.: 633,511

[22] Filed: Jul. 23, 1984

[51] Int. Cl.[4] ..... A62C 7/00

[52] U.S. Cl. ..... 169/50; 169/65

[58] Field of Search ..... 169/43, 46, 48–50, 169/65; 24/72.5, 303; 160/349 R, 349 D, 352, DIG. 16

[56] References Cited

U.S. PATENT DOCUMENTS

| | | | |
|---|---|---|---|
| 2,595,833 | 5/1952 | Flaherty | 160/DIG. 16 X |
| 2,720,269 | 10/1955 | Diacos | 169/50 |
| 3,107,361 | 10/1963 | Glutting, Sr. | 160/349 R X |
| 3,805,872 | 4/1974 | Lorber | 160/DIG. 16 X |
| 4,269,901 | 5/1981 | Chamberlain | 169/50 |
| 4,483,314 | 11/1984 | Parker, Jr. et al. | 169/50 X |

*Primary Examiner*—Joseph F. Peters, Jr.
*Assistant Examiner*—Mary Beth O. Jones
*Attorney, Agent, or Firm*—C. Emmett Pugh & Associates

[57] ABSTRACT

A fire resistant blanket which is tossed or placed over a fire in order to smother the flames comprising a square shaped blanket made of a permanently fire proof material, on the backside of which are attached two handles made of the same clothlike material. At strategic points about the perimeter magnets are positioned and secured in pockets of the blanket. The blanket's primary function is to be used to extinguish small household fires such as may arise in the kitchen while cooking. The blanket is designed to allow storage directly on the side of a refrigerator or other metallic surface or on the kitchen wall by draping over a dowel where it will be readily accessible in the event of a kitchen fire. The handles on the back are designed to allow the operator to approach the fire while protecting himself and his hands. The spaced magnets weight the blanket optimally for tossing the blanket onto a fire. Additionally the magnets are placed to allow the optimal benefit of their magnetic effect when placed on the objects which contain the fire, such as pots or the metallic stove surface, and to anchor the blanket in position over the fire which it is to smother.

5 Claims, 8 Drawing Figures

MAGNETIC FIRE BLANKET

BACKGROUND OF INVENTION

1. Field of Invention

The present invention relates to a fire extinguishing device. More particularly, the present invention relates to a fire blanket which will extinguish a fire by depriving the fire of oxygen when placed over the fire in such a way that it covers the fire, such blanket having handles on the back side and strategically placed magnets about its perimeter.

2. Prior Art

There are prior art patents which teach various different forms of fire extinguishing blankets, however the fire blanket embodied in the present invention is a significant advancement over the blankets of the prior art.

| Patent No. | Patentee(s) | Issue Date |
|---|---|---|
| 1,027,308 | Bishop | May, 1912 |
| 2,720,269 | Diacos | April, 1953 |
| 3,828,856 | Wallis | Aug., 1974 |
| Great Britain | | |
| 15,685 | Edmunds | Aug., 1903 |

Thus, for example, the Edmunds British Pat. No. (15,685) in 1903 teaches the use of a blanket or cover of a material which was chemically treated or otherwise rendered fire proof or made of fire proof material which was to be rectangular in shape with the words "fire" or "fire proof" printed on the corners of the cover. The cover also included means for hanging it on the wall, but this required a special bracket to be mounted on the wall, which is not required by the presently contemplated invention. It was contemplated that the cover could be used to put out small fires, for example "lamp explosions," by it being snatched or quickly picked up, and placed over the flames to smother them. The material was taught to be fireproof, and it was noted that the cover could be made of distinctive colors.

In 1912 the Bishop patent (U.S. Pat. No. 1,207,308) suggested the mounting of a fire blanket so that it could be readily removed from its mounting on the wall. This was accomplished by means of a formed metal mounting clip attached to the blanket, which was snapped over a special bracket mounted to the wall. This accomplished a similar result to the one obtained in the present invention but without the resultant versatility of the magnetically mounted system of the presently contemplated invention.

The fire blanket suggested by Diacos (U.S. Pat. No. 2,720,269) was likewise to be rectangular in form and weighted for casting or throwing in a convenient manner over a combusting area in a household.

The Wallis fire blanket patent (U.S. Pat. No. 3,828,856) suggested that his blanket be of a fire resistant material and could be used to extinguish to fire in a saucepan or from burning fat, with the blanket to be washed and replaced after use. Wallis also suggested a novel method for mounting the blanket, which required the folding of the blanket and its placement in a storage bag.

The prior art does not teach the use of closed handles or of the use of magnets as a mounting means for storage of the blanket. Nor does the prior art teach the use of magnets as a securing means to keep the fire blanket over the flames while smothering them. The prior art does not teach of the positioning of handles to allow the user to protect himself while approaching the fire which is to be extinguished.

Additional prior patents which may be of interest are listed below:

| Patent No. | Patentee(s) | Issue Date |
|---|---|---|
| 2,183,113 | Bennett | June, 1938 |
| 4,269,901 | Chamberlain | May, 1981 |

3. General Discussion of the Invention

The object of this invention is to be able to provide a fire extinguishing device which can be used by anyone in the kitchen without having to use a bulky, expensive, mechanical device such as conventional chemical fire extinguishers. Other disadvantages of such devices include limited knowledge on the part of intended users, apprehension of use, and a lack of the apparatus always being in a ready state.

A further objective is to provide a device which will be able to extinguish a fire on a stove without creating a mess or spoiling food nearby. A common household chemical fire extinguisher will both create a mess and ruin other food being prepared in the vicinity. A fire extinguisher, if not used correctly, can make a fire worse by gouging the burning substance and spreading it.

A fire extinguisher needs to be recharged after each use. The magnetic kitchen fire blanket of the invention can be used repeatedly without the need for recharging or any other costs, the initial investment being all that is needed.

The magnetic kitchen fire blanket of the present invention also avoids the hazard created when water is applied to a stove fire, often resulting in an explosive situation.

The magnetic kitchen fire blanket through its unique properties will enable an operator to extinguish a fire in less than two or three seconds.

The fire blanket is noticeably displayed, conveniently located, easily recognized and simply used in case of an emergency. The fire magnetic kitchen blanket is made of a brightly colored material and can have a clearly visible identification indicating that it is to be used to extinguish fires. Because of its exemplary six or seven magnets, the kitchen fire blanket of the present invention can be stored directly on the surface of the refrigerator or any other metallic surface in the kitchen. The magnetic kitchen fire blanket can also be stored for example draped over a dowel which is suspended from the kitchen wall.

The magnetic kitchen fire blanket of the present invention can also be used in an emergency situation to protect one's self or a child when trying to escape a fire.

The magnetic kitchen fire blanket preferrably is made of an inherently fire resistant or fire proof fabric. The flame resistant characteristic can be part of the fiber itself, rather than just an additive, coating or special treatment. Its protective quality thus cannot be washed out or worn off.

The magnetic kitchen fire blanket of the present invention is also attractive and serves a secondary function as a decorative display when not in use.

The magnetic kitchen fire blanket of the present invention is preferrably about 24"×24" for home use and about 33"×33" for commercial applications, because such sizes will cover most cooking pots that will be used on a stove in a home or in restaurants, respectively.

It preferrably has two handles which can be for example six and a half (6½") or seven (7") inches in length, so a person can hold the fire blanket so as to protect the upper part of the body and hands while approaching a fire, and protect the person when he places the fire blanket over the burning pot.

The magnetic kitchen fire blanket preferrably has six or seven magnets placed at strategic locations such that the north and south poles of said magnets are oriented that the same pole of all but the lower center perimeter magnet face the same direction so as to best benefit their magnetic effects when placed on a metal surface, such as a stove or on a cooking utensil such as a pot, when trying to extinguish a stove fire. Such an arrangement holds the blanket securely over the flame, enabling the fire to be smothered quickly.

The top two magnets preferrably are positioned just above the handles so that they can be controlled when the blanket is prepared for use. These magnets preferrably are located about three inches down from the edge of the blanket to allow for a flap should the magnets fall short of covering the area desired.

The remaining four or five magnets preferably are placed at or near the edges so as to cause a dragging and anchoring effect.

BRIEF DESCRIPTION OF THE DRAWINGS

For a further understanding of the nature and objects of the present invention, reference should be had to the following detailed description, taken in conjunction with the accompanying drawings in which like parts are given like reference numerals and wherein.

DETAILED DESCRIPTION OF THE PREFERRED EXEMPLARY EMBODIMENT(S)

Figure 1:
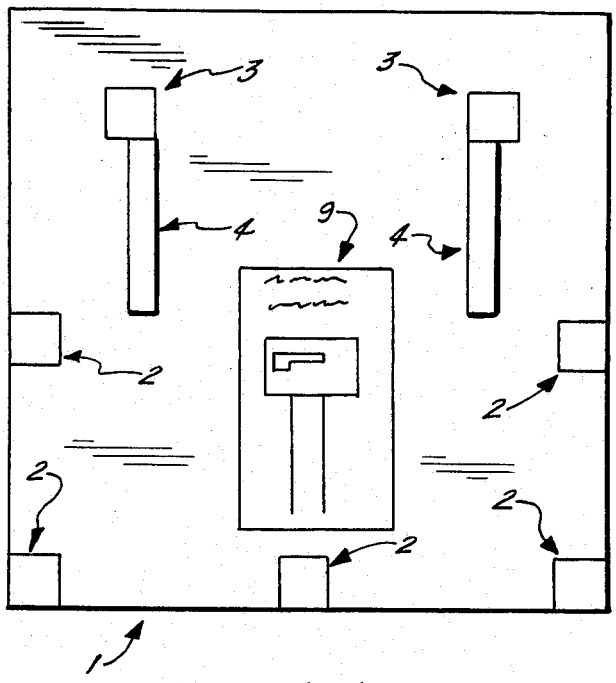
FIG. 1 is a back view of a first, "home" preferred embodiment of the magnetic fire extinguishing blanket of the present invention.
Figure 7:
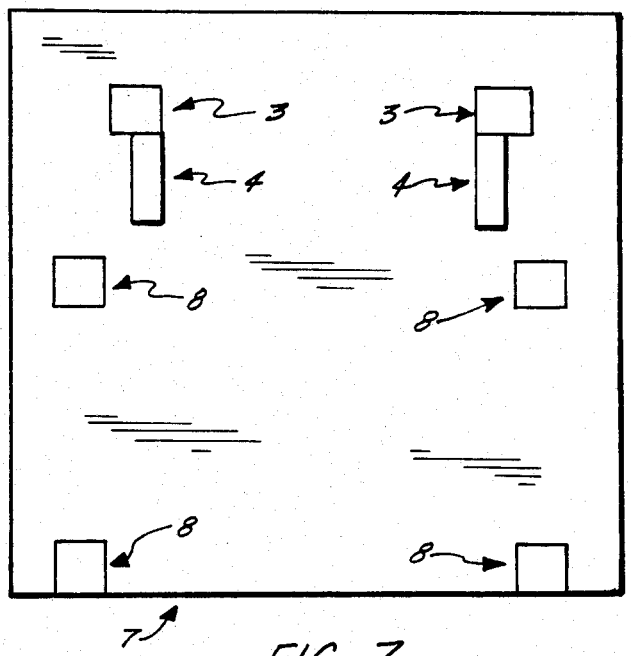
FIG. 7 is a back view of a second, "commerical" preferred embodiment of the invention, larger in size than the first embodiment.

The two preferred embodiments of the magnetic kitchen fire blanket of the present invention are illustrated in FIGS. 1 and 7.

Figure 5A:
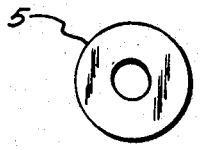
FIGS. 5 A&B are front and side views, respectively, of exemplary permanent magnets which are inserted into the pockets sewn into the fabric of the blanket.
Figure 5B:
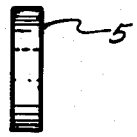
Figure 6:
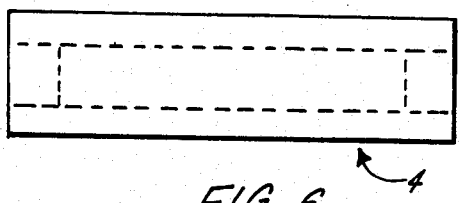
FIG. 6 is an unfolded view of one of the cloth handles of the blanket prior to folding and stitching.

The magnetic kitchen fire blanket is made up of three basic elements, the exemplary 24"×24" square cloth 1 (FIG. 1) or 33"×33" square cloth 7 (FIG. 7) comprising the body of the blanket, the magnets having a dimension of one and one quarter inches by one and one quarter inches thick (see FIGS. 5 A&B) are located in the pockets 2, 3 or 8 of the blanket, and the two handles 4 which are attached to the backside of the blanket.

Figure 2:
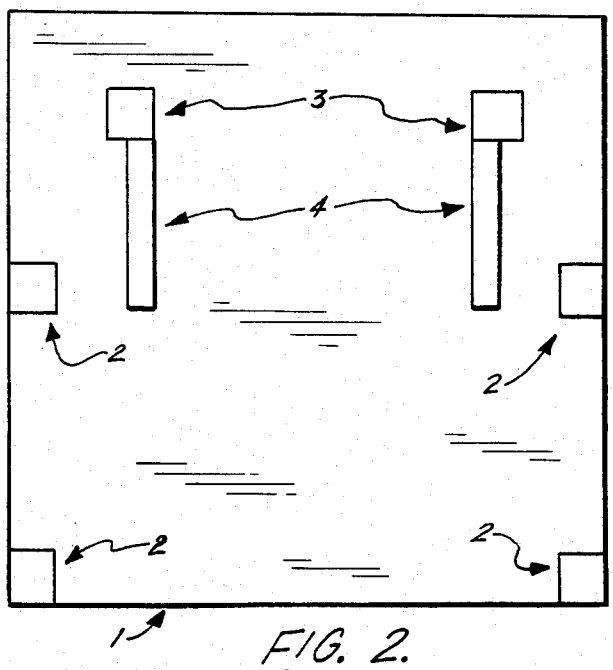
FIG. 2 is a back view of an alternate configuration showing alternate placement of the magnets.

Exemplary two inch (2") squares of cloth 2, 3 and 8 are sewn onto the blanket to form pockets at the exemplary locations shown in FIG. 1, FIG. 2 or FIG. 7. Three sides are permanently secured while the fourth is left open to accommodate the insertion of the permanent magnets seen in FIG. 5. Once the magnets are in place the fourth and final edge of the pocket is secured by either a permanent or temporary closure means.

Two for example six and a half (6½") to seven inch (7") long and one and one quarter inches wide handles 4 which are formed from a nine by two and one half inches rectangular piece of cloth are attached as shown an exemplary five inches (5") down from the top edge of the blanket and four and one half inches from the sides of the blankets. These handles are located in order to allow the operator of the fire blanket to protect himself from the fire when approaching the flames.

The top two magnet pockets 3 are preferrably positioned directly above the handles 4 in order to provide control of the permanent magnets placed in these pockets 3 in order to insure proper placement of these magnets in relation to the fire.

These two magnet pockets 3 are located preferrably for example three inches down from the top edge of the blanket and three and one half inches from the side edges of the blanket to allow for a flap to be forward, should the magnets fall short of covering the area desired.

The remaining five magnet pockets 2 or 8 are placed either at the edges (pockets 2, with the upper pair being positioned twelve inches down from the top edge, and the bottom three spaced nine inches apart) so as to cause an anchoring effect when the blanket is placed over the burning object, of for example about four inches (4") in from the edge (pockets 8, with the upper pair being positioned fourteen inches down from the top, and the bottom pair being spaced fifteen inches below the upper pair) to provide a covering flap should the magnets fall short of covering the desired area. These magnets will magnetically secure the blanket to the surface of a stove surrounding and covering over a burning pot or to a metal pot itself, or at least act as weights on a non-metallic surface weighing the blanket down over the fire.

Figure 3:
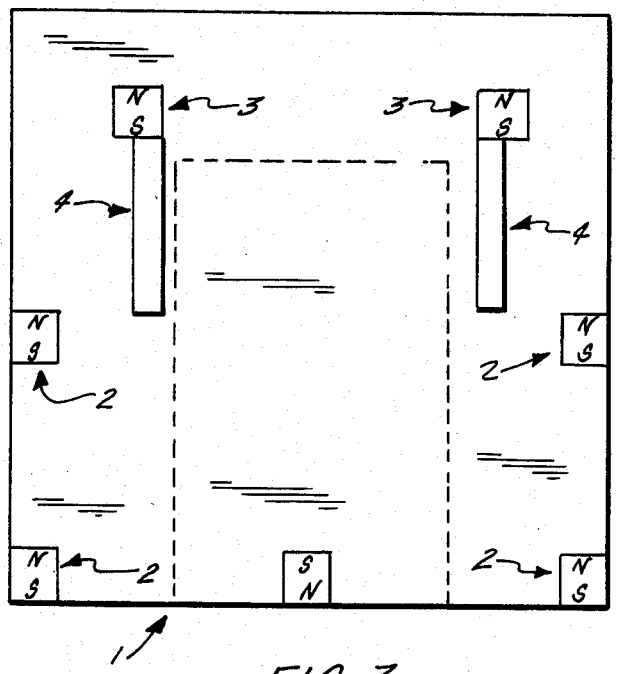
FIG. 3 is a back view illustrating the preferred folding configuration whereby the opposing magnets magnetically adhere to each other to keep the blanket folded.
Figure 4:
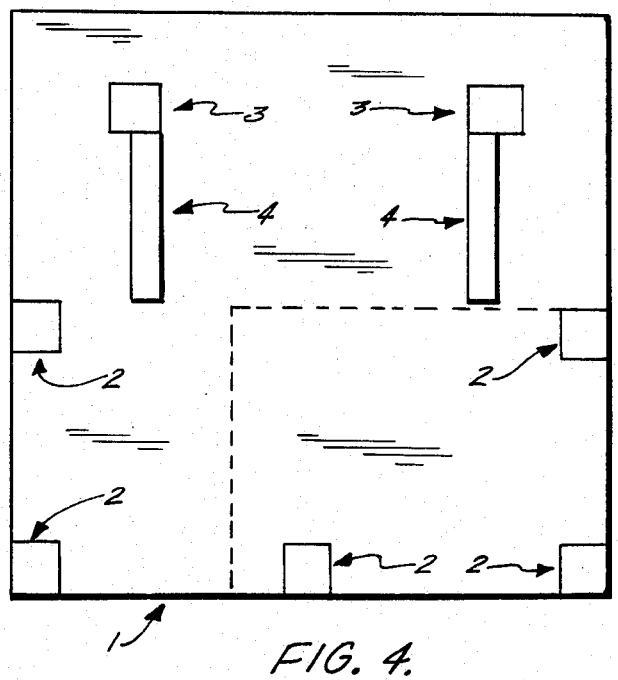
FIG. 4 is a back view of an alternate folding configuration yielding a smaller folded dimension.

The location of the preferred fold lines are shown in dashed lines in FIGS. 3 and 4, with the dimensions of the folded blanket being twelve inches by fifteen inches as shown in FIG. 4.

The magnetic, kitchen fire blanket is held from behind by the operator grasping the two handles 4 one in each hand. The blanket is preferrably oriented so that the five perimeter magnet pockets 2 are below the handles 4 thereby positioning the remaining two magnets in pockets 3 directly above the handles 4. The exemplary five inches (5") of material above the handles 4 is allowed to drape back towards the operator covering and protecting his hands.

The operator then approaches the fire with the blanket held in front of him to protect him from the fire. The blanket is then placed or thrown over the flames and secures itself in place through the magnets and thusly the fire is extinguished. The presence of the magnets 5, being a little over a half ounce each in weight and spaced about the blanket gives added momentum and direction to the blanket when it is thrown, causing it to stay spread out in covering over the fire.

The preferred embodiment also has imprinted upon it an attractive pattern 9, message or advertisement (note FIG. 1). The blanket is preferrably made of a brightly colored material and can have on it a clearly visible identification or symbol which indicates that the blanket is to be used to extinguish fires. These features make the blanket visually appealing, and readily recognizable in the event a need to use the blanket arises.

The blanket can be made of any fire resistant, smothering material, and many such materials are known in the art.

Because many varying and different embodiments may be made within the scope of the inventive concept herein taught, and because many modifications may be made in the embodiment(s) herein detailed in accordance with the descriptive requirements of the law, it is to be understood that the details herein are to be interpreted as illustrative and not in a limiting sense.

What is claimed is:

1. A fire extinguishing device, comprised of:

a fire proof blanket;

two handles for manually grasping said fire proof blanket prior to placing it over a fire wherein said handles are mounted on the back of said blanket at positions spaced substantially below the top edge of said blanket so that the portion of said blanket between said handles and said top edge is allowed to drape back towards the operator covering and protecting his hands, said handles providing greater control of the placement of the blanket by the operator for more effective operation; and magnetic securing means fixed to the blanket for keeping said fire proof blanket secured over the fire when in a metallic environment, comprising a plurality of perimeter magnets mounted in spaced relation along the perimeter of said blanket at positions below said two handles; and two additional magnets, spaced inwardly from said perimeter and lying directly above, but not substantially spaced from said two handles, respectively.

2. The fire extinguishing device of claim 1, wherein said plurality of perimeter magnets includes a lower center perimeter magnet and the north poles of said two additional magnets and all of said plurality of perimeter magnets except said lower center perimeter magnet are oriented in the same direction.

3. The fire extinguishing device of claim 1, wherein the magnetic securing means are of sufficient weight to secure the blanket in position even in a non-metalic environment.

4. The fire extinguishing device of claim 1, wherein said handles are about six-and-half (6½") to seven inches (7") in length and are positioned about five inches (5") below the top edge of the blanket to provide more effective coverage of the fire, greater control of the placement of the fire blanket and to afford protection to the operator.

5. The fire extinguishing device of claim 1, wherein said handles are attached to said fire blanket at both ends of said handles so as to form a closed loop handle.

* * * * *